US008427034B2

(12) United States Patent
King et al.

(10) Patent No.: US 8,427,034 B2
(45) Date of Patent: Apr. 23, 2013

(54) FLOORING SYSTEMS AND METHODS OF MAKING AND USING SAME

(75) Inventors: Wesley A. King, Rockwall, TX (US); David A. Earl, Flower Mound, TX (US)

(73) Assignee: Mohawk Carpet Corporation, Calhoun, GA (US)

( * ) Notice: Subject to any disclaimer, the term of this patent is extended or adjusted under 35 U.S.C. 154(b) by 78 days.

(21) Appl. No.: 13/266,711

(22) PCT Filed: Apr. 27, 2010

(86) PCT No.: PCT/US2010/032579

§ 371 (c)(1), (2), (4) Date: Oct. 27, 2011

(87) PCT Pub. No.: WO2010/129281

PCT Pub. Date: Nov. 11, 2010

(65) Prior Publication Data

US 2012/0043852 A1 Feb. 23, 2012

Related U.S. Application Data

(60) Provisional application No. 61/173,163, filed on Apr. 27, 2009.

(51) Int. Cl.
*H01L 41/08* (2006.01)

(52) U.S. Cl.
USPC ..... 310/339

(58) Field of Classification Search ..... 310/329, 310/339
See application file for complete search history.

(56) References Cited

U.S. PATENT DOCUMENTS

| | | | | |
|---|---|---|---|---|
| 4,706,069 | A * | 11/1987 | Tom et al. | 340/541 |
| 2002/0145350 | A1* | 10/2002 | Henderson | 310/112 |
| 2008/0184646 | A1 | 8/2008 | Alford et al. | |
| 2010/0084871 | A1* | 4/2010 | Filardo | 290/54 |
| 2010/0187832 | A1* | 7/2010 | Holland et al. | 290/1 A |
| 2010/0295322 | A1* | 11/2010 | Brezet et al. | 290/1 A |
| 2010/0308691 | A1* | 12/2010 | Hayamizu | 310/339 |
| 2011/0074249 | A1* | 3/2011 | Sakashita et al. | 310/339 |
| 2011/0278989 | A1* | 11/2011 | Sato et al. | 310/339 |
| 2012/0074815 | A1* | 3/2012 | Jean-Mistral | 310/339 |

FOREIGN PATENT DOCUMENTS

| | | |
|---|---|---|
| EP | 05039661 | 2/1993 |
| WO | 2006102437 | 9/2006 |
| WO | 2007019183 | 2/2007 |

OTHER PUBLICATIONS

International Search Report and Written Opinion dated May 12, 2011 for related PCT Patent Application No. PCT/US2010/032579.

* cited by examiner

*Primary Examiner* — Mark Budd
(74) *Attorney, Agent, or Firm* — Troy S. Kleckley; Troutman Sanders LLP

(57) ABSTRACT

The various embodiments of the present invention are directed to floating floor systems and to methods of making and using the floor systems. The floating floor systems generally include a floating flooring unit (704) and a mechanical-energy-harvesting device (710). The mechanical-energy-harvesting device can be incorporated into the flooring unit component at a variety of locations. The floor systems can further include an energy storage device (712) and/or an electronic component that will be actuated or driven by the electricity generated.

28 Claims, 9 Drawing Sheets

FLOORING SYSTEMS AND METHODS OF MAKING AND USING SAME

CROSS-REFERENCE TO RELATED APPLICATIONS

This application claims, under 35 U.S.C. §119, the benefit of International Patent Application Serial Number PCT/US2010/032579, filed 27 Apr. 2010, which claims the benefit of U.S. Provisional Application Ser. No. 61/173,163, filed 27 Apr. 2009, both of which are hereby incorporated by reference in their entirety as if fully set forth below.

TECHNICAL FIELD

The various embodiments of the present invention relate generally to flooring systems and their installation. More particularly, the various embodiments of the invention relate to improved flooring systems for use in harvesting energy and to methods of making and using such flooring systems.

BACKGROUND

Flooring systems are widely used as floor coverings in both residential and commercial applications, owing at least in part to their versatility, availability in nearly unlimited colors and designs, and durability. Such flooring system components can be formed from ceramic, marble, granite, quartz, natural stone, porcelain, wood, glass, a variety of metals or polymers, and the like.

Conventional installed flooring (e.g., grouted ceramic tiles, nailed-down hardwood floors, glued-down vinyl sheets, and the like) is fixed in place to the mounting surface with the general goal of avoiding any movement of the flooring after installation. In such floors, the mechanical forces imparted to the floor (e.g., via people's feet, rolling wheels, or the like) primarily exert forces downward and are spread over the area of the flooring unit. These conventional floors are termed "non-floating floors" and are normally affixed to the mounting surface securely such that there is minimal movement, both laterally (i.e., parallel to the plane of the floor) and vertically (i.e., perpendicular to the plane of the floor). The incorporation of additional devices, such as those that harvest mechanical energy, into such floors would be permanent. This means that repair of either the flooring or the devices (and associated components) would be destructive to both the flooring and the devices, requiring much labor and cost.

Floating floor systems typically are not permanently affixed to a sub-floor or mounting surface, and easily can be installed or removed, thereby allowing ready access to the area under the floating floor. Such flooring does move slightly under load and can even be designed such that the flooring units (e.g. ceramic tiles, laminate planks, wooden floor planks, or the like) move substantially in a vertical direction ("press in") or deflect when subjected to a downward force from a pedestrian or vehicle. This downward force, however, is spread over the cross-section of the flooring unit that is being displaced, so efficient harvesting of this mechanical force could be maximized only by a device or array of devices that covers the entire bottom surface of the floor. Such device arrays (e.g., including films, sheets, mats, and the like) have been disclosed in the prior art. This methodology requires a large area to be covered by sensors/devices and could therefore be expensive and/or time consuming to install.

This approach also raises the issues of practicality and expected reliability in service. To illustrate, walking on a floor that deflects noticeably under one's weight could be uncomfortable and even unsafe, increasing the risk of, for example, tripping. In one example, there exist floors that "rock" or rotate slightly about some pivot point, thereby permitting substantial motion such that the floor exerts variable forces on piezoelectric elements placed under the rocking member(s). Similar to floors that "press-in," this method has negative aspects related to pedestrian safety (e.g., tripping) and the mechanical longevity of the flooring.

Accordingly, there is a need for improved flooring systems that make use of energy harvesting components/devices. It is to the provision of such systems, and the associated methods of manufacture and use that the various embodiments of the present invention are directed.

BRIEF SUMMARY

Various embodiments of the present invention are directed to improved floating floor systems. Other embodiments are directed to methods of making the floor systems. Still other embodiments are directed to methods of using the floor systems.

The improved flooring systems can contain circuitry and electronic devices that are used to harvest energy by converting mechanical energy into electricity. More specifically, the flooring systems can incorporate devices that convert mechanical energy (e.g., vibration, impact, or strain) to electrical energy. The floor systems can also include easy-to-assemble floor unit designs that can be installed using mechanical joints that allow adjacent components to be mated together to form a floor surface.

According to some embodiments of the present invention, a floating flooring unit can include a decorative component and a mechanical-energy-harvesting-device. The mechanical-energy-harvesting-device can be disposed on or within a mechanical joint profile of the floating flooring unit, on an underside of the decorative component, within a groove or channel in the underside of the decorative component, or a combination comprising at least one of the foregoing. The mechanical joint profile of the floating flooring unit is configured to couple the floating flooring unit to an adjacent floating flooring unit.

The floating flooring unit can further include an energy storage device, an electronic component configured to be actuated by any electricity generated by the mechanical-energy-harvesting-device, a conductive circuit component, and/or circuitry. The electronic component can be an antenna, pressure sensor, humidity sensor, temperature sensor, transmitter, electrical switch, or the like. The conductive circuit component can be disposed on or within the mechanical joint profile and circuitry for electrically interconnecting the floating flooring unit with the adjacent floating flooring unit. The circuitry can be used for electrically interconnecting the floating flooring unit with the adjacent floating flooring unit.

In certain situations, the floating flooring unit can be a groutless tile flooring unit, wherein the decorative component is a tile disposed within a groove of a substrate, wherein the substrate comprises the mechanical joint profile. In addition to, or in the alternative to, being located within a mechanical joint profile of the floating flooring unit, on an underside of the decorative component, within a groove or channel in the underside of the decorative component, or a combination comprising at least one of the foregoing, the mechanical-energy-harvesting device can be located in a groove or channel in the underside of the substrate, in a groove or channel in the topside of the substrate, entirely encapsulated in the substrate, or a combination comprising at least one of the foregoing.

The groutless tile flooring unit can further include an energy storage device, an electronic component configured to be actuated by any electricity generated by the mechanical-energy-harvesting-device, a conductive circuit component disposed on or within the mechanical joint profile of the substrate, and/or circuitry for electrically interconnecting the groutless tile flooring unit with an adjacent groutless tile flooring unit.

The mechanical-energy-harvesting-device can be a piezoelectric material-containing device, a magneto-inductive device, or an electrostatic structure-containing device. In some cases, the mechanical-energy-harvesting-device can be a microelectromechanical system (MEMS) device.

According to some embodiments of the present invention, a floating floor system can include a floating flooring unit comprising a decorative component and a mechanical-energy-harvesting-device. The mechanical-energy-harvesting-device can be disposed on or within a mechanical joint profile of the floating flooring unit, on an underside of the decorative component, within a groove or channel in the underside of the decorative component, or a combination comprising at least one of the foregoing. The mechanical joint profile of the floating flooring unit can be configured to couple the floating flooring unit to an adjacent floating flooring unit within the floating floor system.

The floating flooring system can further include an energy storage device, an electronic component configured to be actuated by any electricity generated by the mechanical-energy-harvesting-device, a conductive circuit component disposed on or within the mechanical joint profile, and/or circuitry for electrically interconnecting the floating flooring unit with the adjacent floating flooring unit. The electronic component can be an antenna, pressure sensor, humidity sensor, temperature sensor, transmitter, camera, electrical switch, or the like.

In certain situations, the floating flooring unit can be a groutless tile flooring unit, wherein the decorative component is a tile disposed within a groove of a substrate and wherein the substrate comprises the mechanical joint profile. In addition to, or in the alternative to, being located within a mechanical joint profile of the floating flooring unit, on an underside of the decorative component, within a groove or channel in the underside of the decorative component, or a combination comprising at least one of the foregoing, the mechanical-energy-harvesting device can be located in a groove or channel in the underside of the substrate, in a groove or channel in the topside of the substrate, entirely encapsulated in the substrate, or a combination comprising at least one of the foregoing.

The groutless tile flooring unit can further include an energy storage device, an electronic component configured to be actuated by any electricity generated by the mechanical-energy-harvesting-device, a conductive circuit component disposed on or within the mechanical joint profile of the substrate, and/or circuitry for electrically interconnecting the groutless tile flooring unit with an adjacent groutless tile flooring unit. The electronic component can be disposed on or within an underside or topside of the substrate.

According to some embodiments of the present invention, a method of generating electrical energy includes exerting a force on a floating floor system, transferring the force to the mechanical-energy-harvesting-device, and producing electricity from the mechanical-energy-harvesting-device. The floating floor system of such a method can be any of the floating floor systems describe herein. Exerting the force can include stepping on the floating flooring unit and/or contacting an inanimate object to the floating flooring unit. Transferring the force can include impacting the mechanical-energy-harvesting-device, straining the mechanical-energy-harvesting-device, and/or vibrating the mechanical-energy-harvesting-device.

The method can further include delivering the electricity to an energy storage device. In addition, or in the alternative, the method can also include delivering the electricity to an electronic component configured to be actuated by the electricity produced by the mechanical-energy-harvesting device, and actuating the electronic component.

Other aspects and features of embodiments of the present invention will become apparent to those of ordinary skill in the art, upon reviewing the following detailed description in conjunction with the accompanying figures.

DETAILED DESCRIPTION

Figure 1:
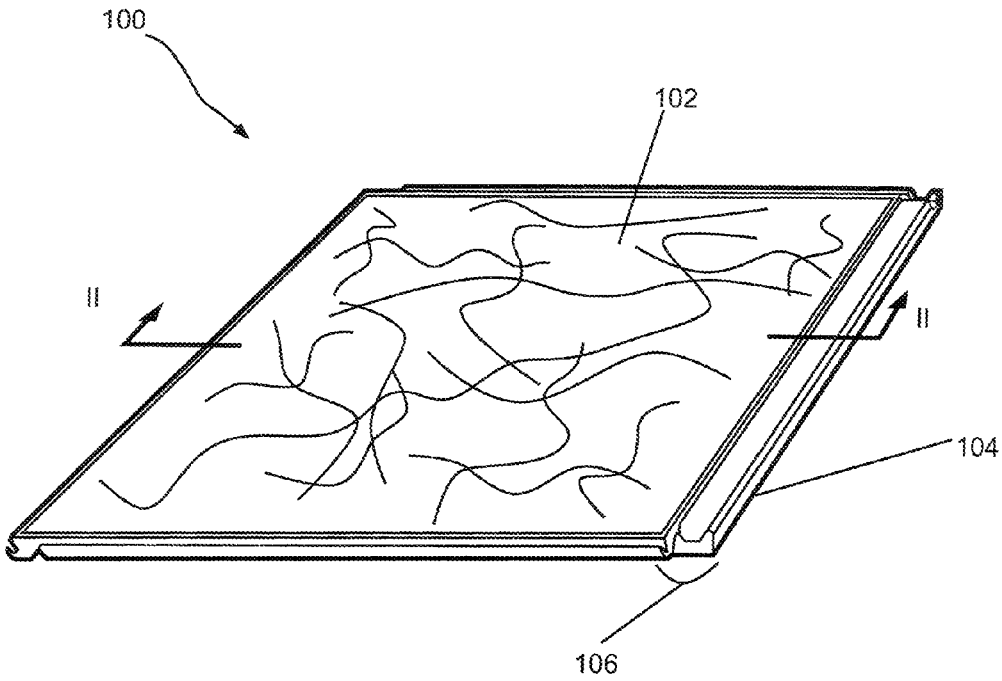
FIG. 1 is a schematic perspective illustration of a groutless ceramic tile flooring unit according to some embodiments of the present invention.

Referring now to the figures, wherein like reference numerals represent like parts throughout the several views, exemplary embodiments of the present invention will be described in detail. Throughout this description, various components may be identified having specific values or parameters, however, these items are provided as exemplary embodiments. Indeed, the exemplary embodiments do not limit the various aspects and concepts of the present invention as many comparable parameters, sizes, ranges, and/or values may be implemented. The terms "first," "second," and the like, "primary," "secondary," and the like, do not denote any order, quantity, or importance, but rather are used to distinguish one element from another. Further, the terms "a", "an", and "the" do not denote a limitation of quantity, but rather denote the presence of "at least one" of the referenced item.

Disclosed herein are improved floating floor systems and methods of making and using the floating floor systems. As described above, the floating floor systems generally include a (i.e., at least one) flooring unit, which comprises a decorative component (e.g., ceramic tile, marble tile, granite tile, quartz tile, natural stone tile, porcelain tile, hardwood planks, engineered wood planks, glass tile, a variety of metal or polymer tiles, and the like) and a mechanical-energy-harvesting device (e.g., piezoelectric devices, magnetic-induction devices, MEMS-based capacitive devices, and like devices). The floor systems can further include an energy storage device and/or an electronic component that will be actuated or driven by any electricity generated as a result of the use of the floor system. The optional energy storage device and/or an electronic component can be included as a portion of the flooring unit or can be external to the flooring unit.

In contrast to existing floor systems, there is no need to cover an entire floor surface with mechanical-energy-harvesting devices with the floor systems disclosed herein. Further, the floor systems disclosed herein provide improved locations for discrete mechanical-energy-harvesting devices where forces due to dynamic loads on the floor are concentrated. As a consequence of this strategic placement, the floor systems described herein do not need to (and preferably do not) move or deflect noticeably or excessively in order to activate the mechanical-energy-harvesting devices. This ultimately results in reduced fabrication costs, greater product reliability, and eliminates potential product safety concerns.

These benefits can be attained by positioning the mechanical-energy-harvesting device at a variety of locations on or within a given flooring unit. As will be described in more detail below, these various possible locations on or within the flooring units can be engineered to have specific profiles that provide a number of design choices for integrating various types of mechanical-energy-harvesting devices, the optional electrical circuitry, and/or the optional energy storage devices needed to convert mechanical energy into electricity and then either store or use the electricity. In fact, as a result of the strategic placement of the mechanical-energy-harvesting devices, it is not necessary for every flooring unit in the flooring systems described herein to include a mechanical-energy-harvesting device in order for the floor systems to function properly.

Easy installation and removal of the flooring unit components gives access to any electronics or other components that would normally be sealed into a cementitious (or other adhesive or fixative) layer with non-floating floor systems. In fact, installation of the flooring systems can be simplified relative to other designs in that the mechanical-energy-harvesting devices, electrical circuitry, and/or energy storage devices can already be incorporated into the floating floor system and would not need to be installed separately under the floor unit components.

For convenience, and not by way of limitation, reference will now be made to floating floor systems where each flooring unit is a ceramic tile encased by a polymeric frame to provide a so-called "groutless tile" unit. Such groutless tile units and systems, while briefly described below, are described in more detail in commonly-assigned United States Patent Application Publication No. 2008/0184646 and International Patent Application Publication No. WO 2008/097860, which are incorporated by reference herein in their entireties as if fully set forth below. In addition to having a ceramic tile encased by a polymeric frame, the floor units of these floor systems generally include mechanical joints for connecting adjacent groutless tiles (flooring units).

FIG. 1 illustrates an exemplary groutless tile, which can be used as a flooring unit of the flooring systems disclosed herein. The groutless tile is generally designated by numeral 100. The groutless tile 100 includes a durable, decorative component 102 (e.g., ceramic tile, marble tile, granite tile, quartz tile, natural stone tile, porcelain tile, hardwood planks, engineered wood planks, glass tile, a variety of metal or polymer tiles, and the like) that is disposed on a substrate 104. As stated above, the decorative component 102 will be described as a ceramic tile in this illustration of a tile unit for convenience.

The decorative component 102 can be affixed to the substrate 104 using a wide variety of methods. The substrate 104 can be constructed of a suitable material that is chemical resistant, stain resistant, at least partially non-porous, and formable to within sufficient precision. In exemplary embodiments, the substrate 104 is formed from a polymeric material. While the groutless tile unit 100 is depicted as square-shaped in FIG. 1, it will be clear that alternatively shaped groutless tiles (e.g., circles, rectangles, diamonds, hexagons, octagons, triangles, and the like) are also contemplated.

The substrate 104 shown in FIG. 1, is designed to have larger dimensions than the decorative component 102 such that the decorative component 102 can be disposed within a groove defined within the substrate 104. The top surface of the decorative component 102 and the top surface of the substrate 104 can form a continuous surface, if desired. The substrate 104 includes a flange portion 106 disposed along the side edges or walls of the substrate 104. The flange portion 106 provides the location of a mechanical joint, which is designed such that it is operable for coupling together one or more adjacent groutless tiles 100. When two or more adjacent groutless tiles 100 are coupled using the mechanical joint of the flange portion 106, it is the top surfaces of the substrates 104 of the coupled tile units 100, which are adjacent to the top surfaces of the decorative components 102, that can provide the appearance of a grouted finish.

Figure 2:
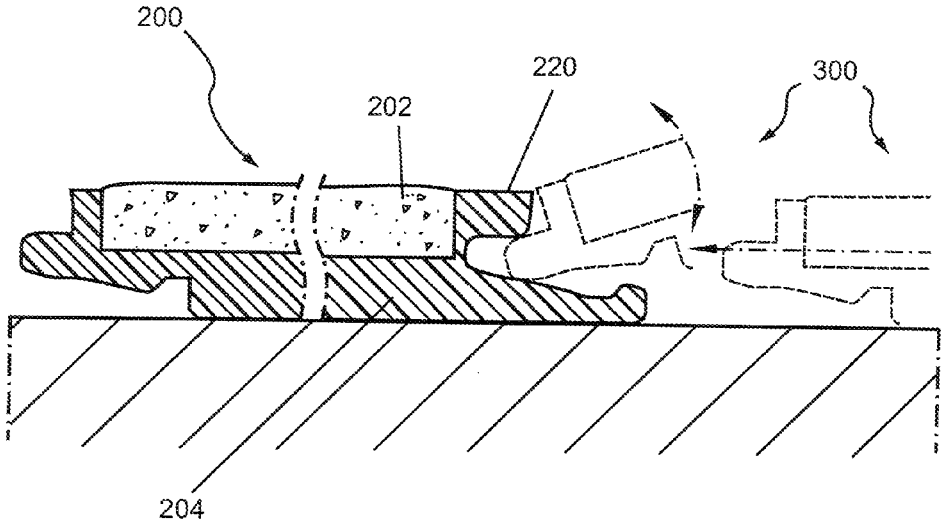
FIG. 2 is a schematic cross-sectional illustration of a process for coupling two groutless ceramic tile flooring units depicted along line II-II of the groutless ceramic tile flooring unit of FIG. 1 according to some embodiments of the present invention.

For the purposes of the tile systems disclosed herein, there is no particular limitation on the type of mechanical joint used to couple the groutless tile units 100. One example of a mechanical joint that can be used is a so-called "tongue-and-groove" joint, an exemplary embodiment of which is shown in greater detail in FIGS. 2 and 3 and described below. Specifically, FIG. 2 illustrates a process for coupling two groutless tile units using a tongue-and-groove mechanical joint, while FIG. 3 illustrates the two groutless tile units in a coupled state.

In these figures, a first groutless tile 200 and a second groutless tile 300 are shown. A first coupling member 220, which comprises a portion of the substrate 204 of the first groutless tile 200, and a second coupling member 340, which comprises a portion of the substrate 304 of the first groutless tile 300, function to connect the first groutless tile 200 and the second groutless tile 300, respectively. The first coupling member 220 of the first groutless tile 200 includes a first bendable portion 222 and a groove 224. The second coupling member 340 of the second groutless tile 300 includes a tongue 346 and a body portion 348. The groove 224 of the first coupling member 220 is designed to receive the body portion 348 and the tongue 346 of the second coupling member 340. Once positioned inside the groove 224 of the first coupling member 220 the body portion 348 and the tongue 346 contacts the first bendable portion 222 and the groove 224, respectively. In one embodiment, the tongue 346 and the first bendable portion 222 are designed to bend at least the first bendable portion during the coupling of the groutless tile 200 and the second groutless tile 300. Additionally, the tongue 346 and the first bendable portion 222 are designed such that at least the first bendable portion 222 returns to or towards its normal unbent position once the first groutless tile 200 and the second groutless tile 300 are coupled in order to prevent the tiles from separating. A contact surface between said tongue 346 and said groove 224 is also formed at the top side of said tongue 346, whereby said contact surface is located in a horizontal plane, which intersects the decorative components 202 and 302.

Figure 3:
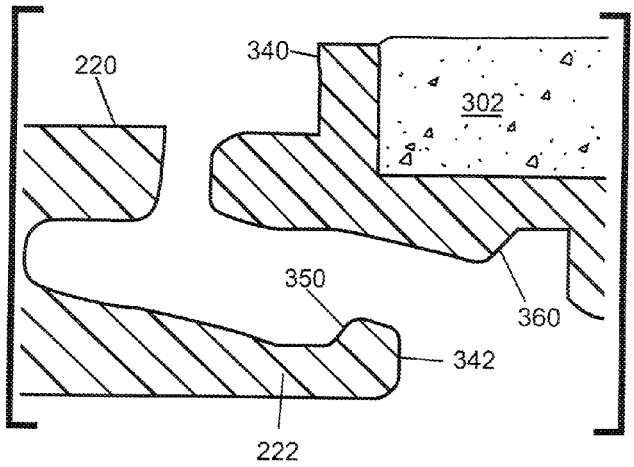
FIG. 3 is a schematic cross-sectional illustration of two groutless ceramic tile flooring units in a coupled state, wherein the two groutless tile flooring units are depicted along line II-II of the groutless ceramic tile flooring unit of FIG. 1, as well as a close-up inset of the tongue-and-groove mechanical joint profiles of the groutless ceramic tile flooring units according to some embodiments of the present invention.
Figure 3:
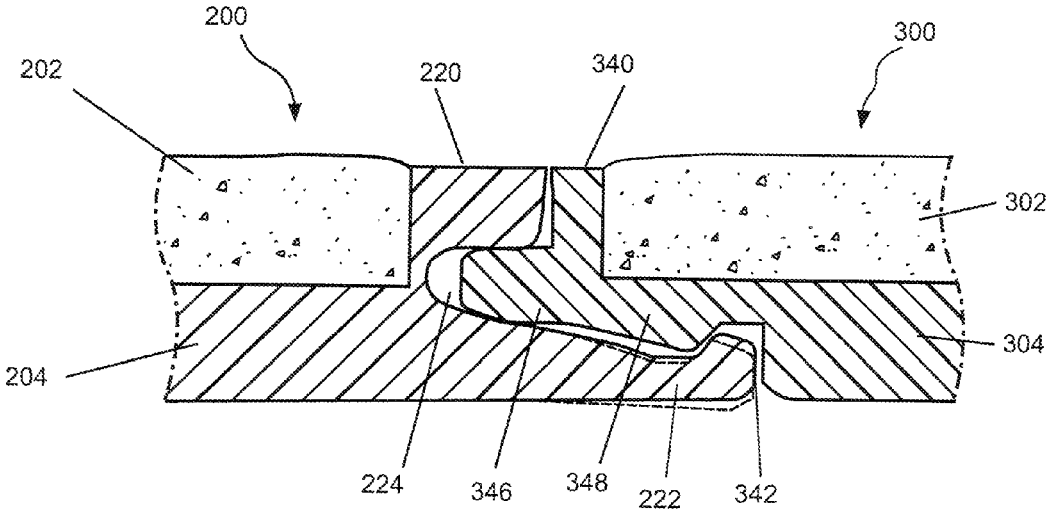

The first bendable portion 222 includes an enlarged portion 342 on its distal end that has an inclined inner surface 350, which is shown in the bracketed inset to FIG. 3. Additionally, the body portion 348 of the second coupling member 340 also includes an inclined surface 360 on its proximal end, which is shown in the bracketed inset to FIG. 3. The inclined inner surface 350 of the enlarged portion 342 of the first bendable portion 222 is designed to have a substantially complimentary angle to the inclined surface 360 of the body portion 348 of the second coupling member 340. The first bendable portion 222 is designed to slideably contact the body portion 348 during the coupling of the first groutless tile 200 and the second groutless tile 300. Furthermore, the inclined surfaces of the first bendable portion 222 and body portion 348 are operable for properly positioning and the first groutless tile 200 and the second groutless tile 300 during coupling. In exemplary embodiments, the inclined surfaces of the first bendable portion 222 and the body portion 348 function to keep the first groutless tile 200 and the second groutless tile 300 properly positioned while the tiles are coupled to one another. The inclined inner surfaces of both the body portion 348 and the enlarged portion 342 form horizontally active locking portions, which in a coupled condition are located vertically under the decorative component of at least one of the groutless tiles 200 and 300. In FIG. 3, this horizontally active locking portion is located under the decorative component 302 of the second groutless tile 300.

The tongue 346 is located at the distal end of the second coupling member 340 and extends substantially horizontally and outwardly from the second groutless tile 300. The tongue 346 of the second coupling member 340 and the groove 224 of the first coupling member 220 are vertically active locking portions and wholly engage vertically under at least a portion of the substrate, whereby this portion of the substrate extends horizontally beyond the decorative component of at least one of the groutless tiles 200 and 300. In FIG. 3, these vertically active locking portions are located under the portion of the substrate 204 that extends horizontally beyond the decorative component 202 of the first groutless tile 200.

As demonstrated in FIG. 2, the first groutless tile 200 can be coupled to the second groutless tile 300 by snapping or pushing the second coupling member 340 of the second groutless tile 300 into the first coupling member 220. Generally, a lateral or horizontal force can be used to couple the first groutless tile 200 and the second groutless tile 300. During the coupling of the first groutless tile 200 and the second groutless tile 300, the second coupling member 340 of the second groutless tile 300 can be locked into position once inserted into the groove 224 of the first coupling member 220. Additionally, the first bendable portion 222 can be bent to accommodate the insertion of the first body portion 348 into the groove 224. After the first groutless tile 200 and the second groutless tile 300 are coupled, the first bendable portion 222 returns to or towards its normal unbent position and remains in contact with the body portion 348. If desired, the first groutless tile 200 and the second groutless tile 300 can be separated from one another by pivotally disengaging the first groutless tile 200 from the second groutless tile 300, preferably without damaging the respective tiles and their coupling members.

There are a number of technologies and related devices that convert mechanical motion or vibration into electricity. Such technologies or methods include piezoelectric materials, magneto-inductive structures, or electrostatic structures; and such structures or devices may be macroscopic (i.e., the features are observable with the unaided eye), or they may comprise microelectromechanical systems (MEMS), having features which are not observable with the unaided eye. Piezoelectric materials possess the particular property of being able to generate a strain or size change when an electrical voltage is applied. Such materials are used in making audio speakers. Conversely, when the piezoelectric material is subjected to a strain or vibration, a small electrical voltage is generated. As technology and device fabrication has advanced, piezoelectric material devices have been used to convert mechanical energy to electricity (i.e., energy "harvesting" from vibration/strain). Magneto-inductive structures can convert motion or vibration into electricity using the principle of Faraday's Law of Induction. This phenomenon describes how an electrical current can be generated or induced in a conductive circuit when the circuit is moved through a non-uniform, varying magnetic field. Small devices containing a movable magnetic element and a fixed conductive circuit generate small electrical currents when the magnetic element vibrates within the circuit. Conversely, these devices might also be configured such that the magnetic element is stationary and the conductive circuit element vibrates. Finally, other device configurations are possible wherein both device components are free to vibrate. Electrostatic structures can convert vibration into electricity in a similar fashion as a microphone. That is, an electrical current can be generated or induced in a conductive circuit via vibration-induced changes in the relative displacement of electrically capacitive elements. Small devices containing a movable capacitive element and a fixed conductive circuit generate small electrical currents when the capacitive element vibrates within the circuit. Finally, MEMS-based devices, which are generally constructed using the fabrication methods used to produce silicon chip integrated circuits, can convert mechanical energy/vibration into electricity using piezoelectric, magneto-inductive, capacitive methods, or a combination of these phenomena.

Regardless of the type of device used to form the mechanical-energy-harvesting device, it is necessary to locate the mechanical-energy-harvesting device where it will be subjected to the requisite vibration in order to generate electricity. As stated above, the mechanical-energy-harvesting device optionally can be connected to either an electrical storage component (e.g., a battery or capacitor) or to an electronic component that will be actuated or driven by the electricity generated by the conversion device. If used, such connections should be made securely and reliably, this being necessary to make use of the electricity generated in the mechanical-energy-harvesting devices.

The mechanical joints of the groutless tiles shown in FIGS. 1 through 3 are designed to provide an easy and secure fastening action when the flooring units are assembled into a floor system. In addition to the interlocking capability, these mechanical joint profiles can be designed to possess multiple locations where either horizontal and/or vertical forces will be directed when the floor system is stepped on or dynamically loaded.

Thus, in some embodiments, the mechanical-energy-harvesting devices can be fitted directly into these designed/engineered locations within the mechanical joints, where strains and vibrations, needed by the mechanical-energy-harvesting devices in order to generate electricity, will be concentrated when the floor is subjected to varying loads. The mechanical joint profiles in the flooring unit components comprising the joints can be made via a milling or machining operation. Thus, special profiles can be designed such that the mechanical-energy-harvesting devices can be placed into cavities or channels in the mechanical joints when the flooring components are assembled into a floor.

Figure 4:
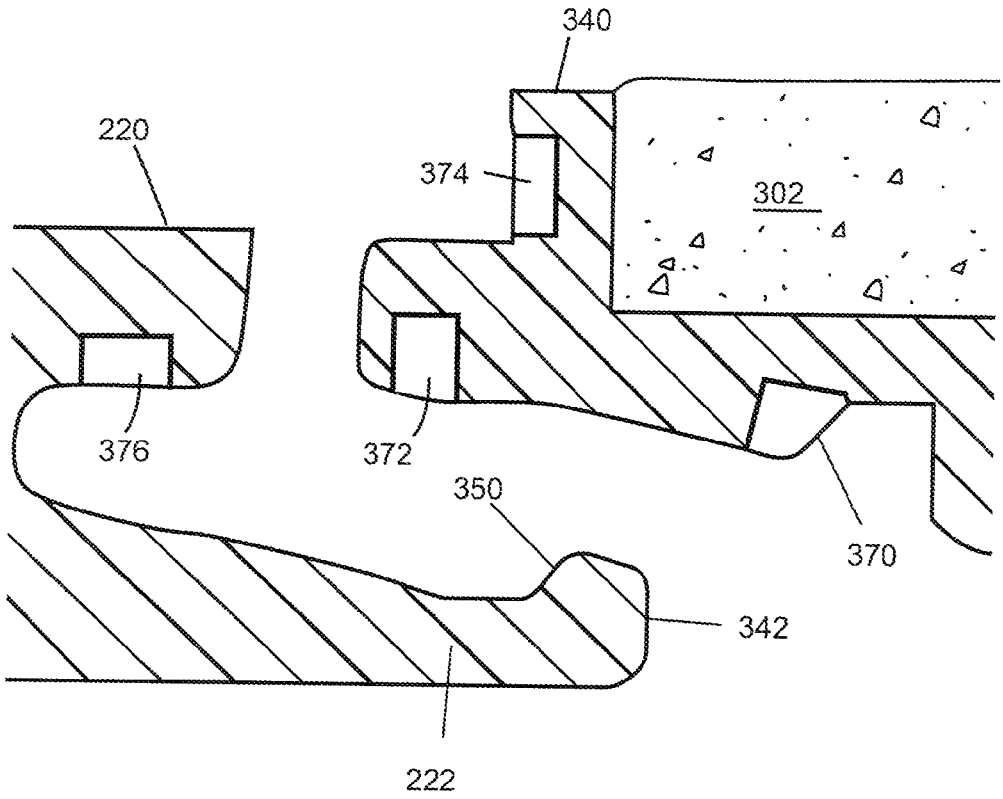
FIG. 4 is the schematic cross-sectional close-up inset of FIG. 3, further depicting regions within the mechanical joint profiles wherein a force concentration is experienced when a load is placed on the decorative ceramic tile component of the groutless tile flooring units according to some embodiments of the present invention.

By way of example, FIG. 4 illustrates the mechanical joint of the groutless ceramic tile system shown in FIGS. 1 through 3 with regions (represented by numerals 370, 372, 374, and 376) within the substrates of the two groutless tile units where a force concentration is experienced when a load is placed on the floor. Such locations are ideally suited for placement of piezoelectric or other devices that convert mechanical (force/strain) energy into electricity, because loads applied to the floor will result in horizontal and vertical force components in these specific areas reliably due to the mechanical joint profile design.

Figure 5:
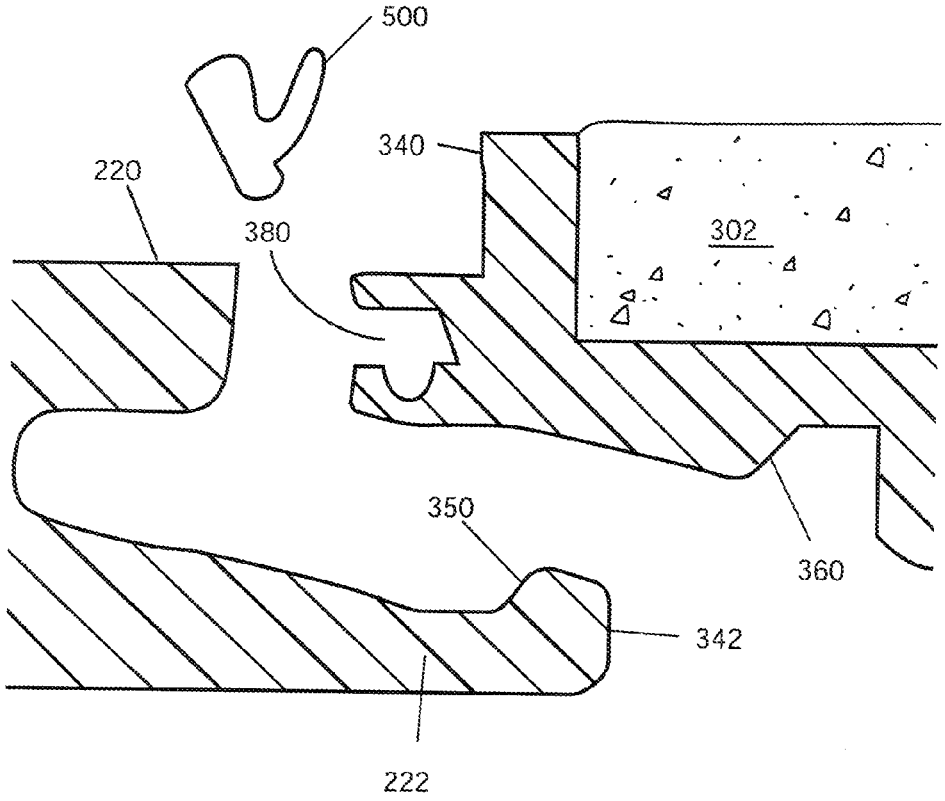
FIG. 5 is the schematic cross-sectional close-up inset of FIG. 3, further depicting a third component that can be used to provide additional locking or security features to the mechanical joint of the groutless ceramic tile flooring units according to some embodiments of the present invention.

The mechanical joint profiles can be designed with the intention of accommodating a separate module/device/component in cavities that are formed when the two profiles are fitted together. An example of this is illustrated in FIG. 5. The mechanical joint of the groutless floor system of FIG. 5 has a modified profile having a third component 500, which can be "nested" in a cavity or channel 380 designed into one or both of the larger, primary mechanical joint profile components. This third component 500 can be used to provide an additional locking feature and/or additional security to the mechanical joint. An example of such a third component 400 is described in more detail in International Patent Application Publication No. 2009/066153, which is incorporated herein by reference in its entirety as if fully set forth below.

The mechanical-energy-harvesting device can be incorporated into this third component 500, which could then be fitted into one of the mechanical joint areas that is reliably subjected to forces/strain when the floor is loaded. In the example shown in FIG. 5, the third component is inserted into the cavity 380 that corresponds approximately to region 372 of FIG. 4. Conversely, the mechanical-energy-harvesting device can be incorporated into either or both of the two primary profiles of the mechanical joint with location(s) selected such that the third component 500 imparts a mechanical force/strain on the embedded device when the floor is dynamically loaded.

When the mechanical-energy-harvesting devices are positioned within one or more regions 370, 372, 374, or 376 within the mechanical joint and/or in conjunction with a third component 500 that is disposed (preferably in one or more of the regions 370, 372, 374, or 376) within the mechanical joint, the mechanical-energy-harvesting devices can be pre-fit into the flooring unit during manufacture, so that the end-user or installer need only assemble the floor to obtain flooring with the energy conversion capability already installed.

Instead of (or in addition to) placing the mechanical-energy-harvesting devices within the mechanical joint area of the groutless tile units, another location where the mechanical-energy-harvesting devices can be incorporated is on the backside or underside of the groutless tile unit.

Figure 6:
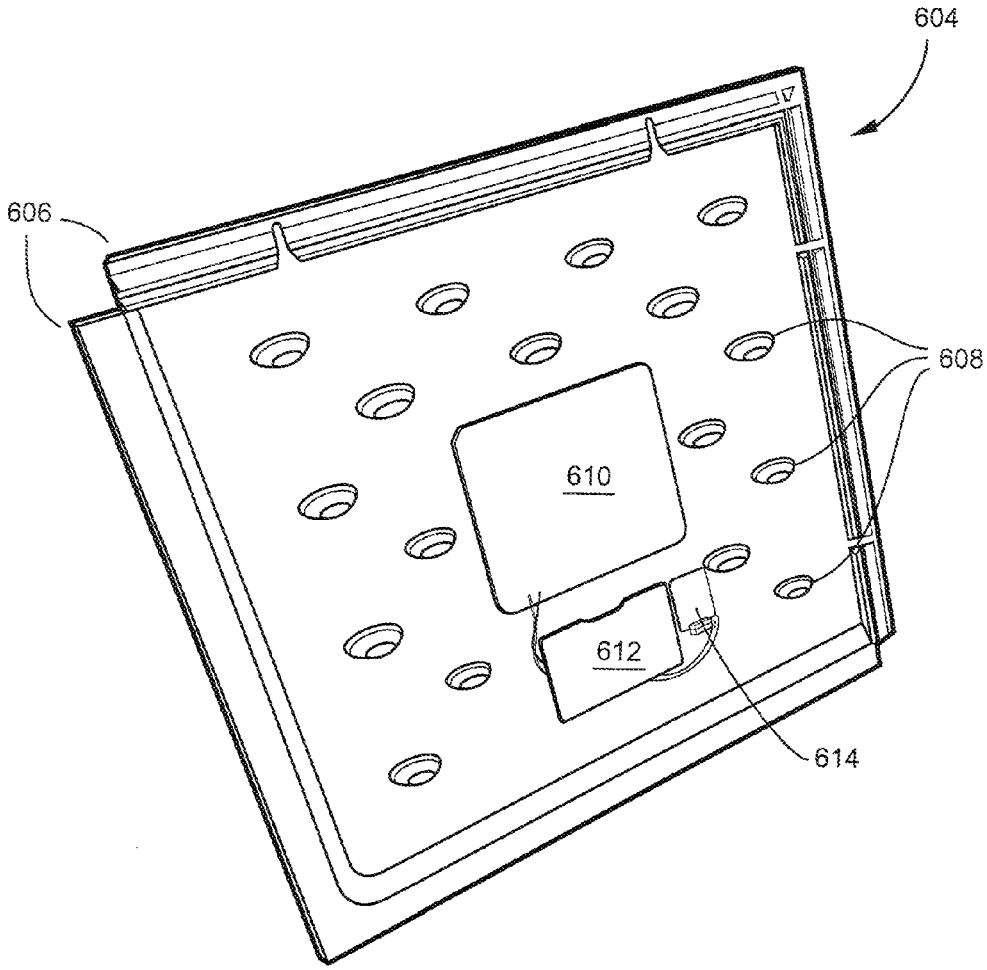
FIG. 6 is schematic perspective illustration of the underside of a groutless ceramic tile flooring unit wherein a mechanical-energy-harvesting device is disposed on the underside surface of the substrate according to some embodiments of the present invention.

In some cases, the mechanical-energy-harvesting device can be placed directly on the underside of the groutless tile unit. This type of design is shown in FIG. 6 for the groutless tile unit of FIG. 1. There is shown in FIG. 6 a view of one type of design for the underside of the substrate 604. The substrate 604 includes the flange portions 606, which are disposed along the side edges or walls of the substrate 604 and are used to form the mechanical joints to couple adjacent groutless tiles. The substrate 604 further includes a plurality of protruding legs, which can be used to at least partially support the groutless tile on the flooring surface on which it is installed. The mechanical-energy-harvesting device 610 can be positioned at any location on the underside of the substrate 604. The mechanical-energy-harvesting device 610 can be held in place using any mechanical device (e.g., screws, clamps, hook-and-loop fasteners, rivets, tape, and the like) or chemical fixative (e.g., glues, epoxies, pressure sensitive adhesives, and the like).

Figure 7:
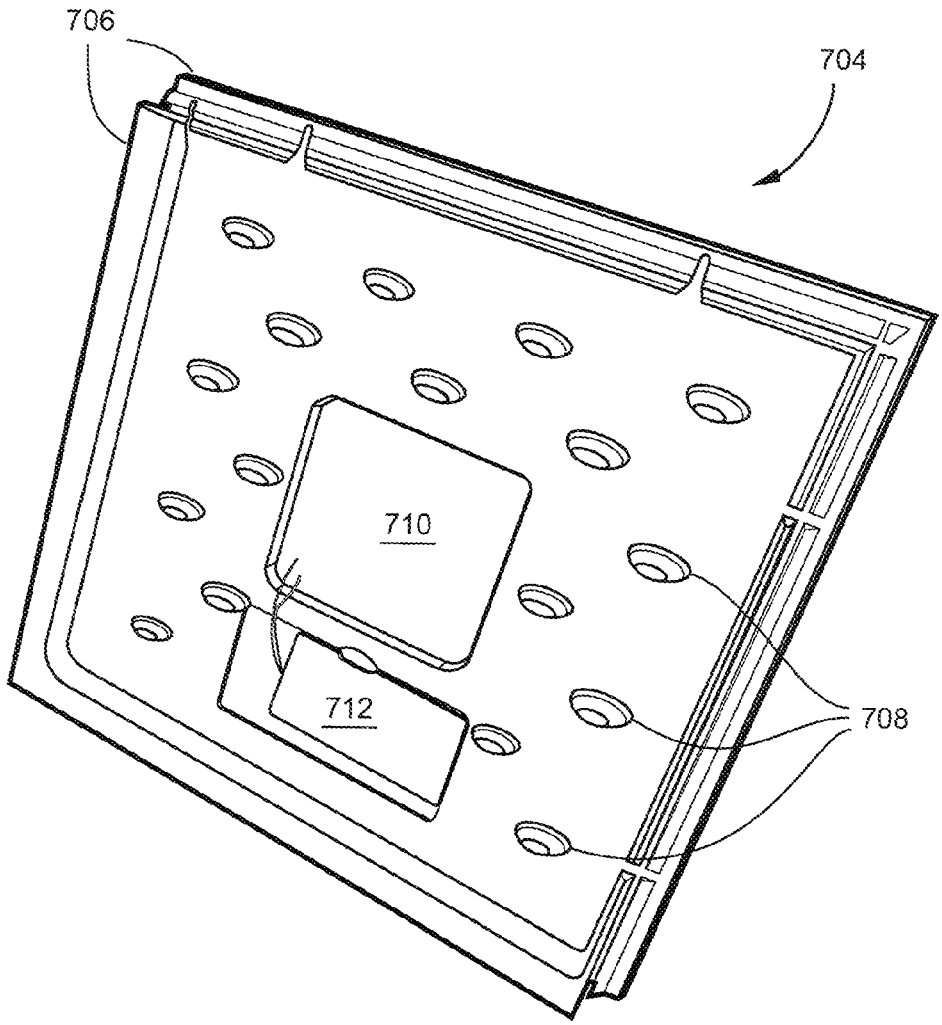
FIG. 7 is schematic perspective illustration of the underside of a groutless ceramic tile flooring unit wherein a mechanical-energy-harvesting device is disposed within a groove or channel within the underside of the substrate according to some embodiments of the present invention.

In other cases, the mechanical-energy-harvesting device can be placed in a groove or cavity within the underside of the groutless tile unit. This type of design is shown in FIG. 7 for the groutless tile unit of FIG. 1. The substrate 704 of FIG. 7 is identical to the substrate 604 of FIG. 6, with the exception that the substrate 704 includes a groove or channel to accommodate the mechanical-energy-harvesting device 710. The depth of the groove or channel comprises at least a portion of the thickness of the substrate 704. That is, in some cases, the depth of the groove or channel can be less than the entire thickness of the substrate 704; while, in other cases, the depth of the groove or channel can be equal to the entire thickness of the substrate 704, thereby rendering the groove an aperture. Again, the mechanical-energy-harvesting device 710 can be positioned at any location on the underside of the substrate 704, and can be held in place using any mechanical device or chemical fixative.

Implementation of the groove or channel may be beneficial in cases where the size of the mechanical-energy-harvesting device 710 is large. In cases where the mechanical-energy-harvesting device 710 is too large, it is also possible for a portion of the decorative component of the groutless tile to have a groove or channel defined therein.

Another location where the mechanical-energy-harvesting devices can be incorporated, instead of (or in addition to) those described above, is on the topside of the groutless tile substrate. In some situations, since the decorative component is disposed within a groove defined within the topside of the substrate (as shown in FIGS. 1 through 5), a so-called "deeper" or "additional" groove can be present in the location where the mechanical-energy-harvesting device will be positioned. The additional or deeper groove for the mechanical-energy-harvesting device can be fabricated during or after manufacture of the substrate. In one example, the mechanical-energy-harvesting device can be coupled to the underside of the decorative component, and the substrate can be molded around the decorative component/mechanical-energy-harvesting device combination. In another example, the substrate can be molded or machined to have the additional groove to contain the mechanical-energy-harvesting device.

Still other options for the mechanical-energy-harvesting device include being encapsulated by the material from which the substrate is formed. For example, the mechanical-energy-harvesting device can be placed in a mold before any polymer is placed therein. Once the polymer is injected or poured into the substrate, the polymer will encapsulate the mechanical-energy-harvesting device such that some or all of the mechanical-energy-harvesting device is contained entirely within the polymer substrate.

As was the case for the mechanical joints, when the mechanical-energy-harvesting devices are positioned directly on the underside, within a channel/groove within the topside or underside of the groutless tile substrate, or are entirely encapsulated by the substrate, the mechanical-energy-harvesting devices can be pre-fit on/within the substrate (and, potentially, the decorative component) during manufacture, so that the end-user or installer need only assemble the floor to obtain flooring with the energy conversion capability already installed.

Similarly, any optional additional electrical connections, circuitry, and other components associated with storing and utilizing the electricity generated by the mechanical-energy-harvesting devices can also be included in the groutless tile units. Each of the positions described above for positioning the mechanical-energy-harvesting devices can be used for positioning these additional items. This would also eliminate the need for a customer or installer to place the electrical system components under the floor separately, greatly easing installation, as well as reducing the likelihood of damage to the system components during installation or subsequent use since they are protected by the structure of the flooring units that comprise the flooring system.

Figure 8:
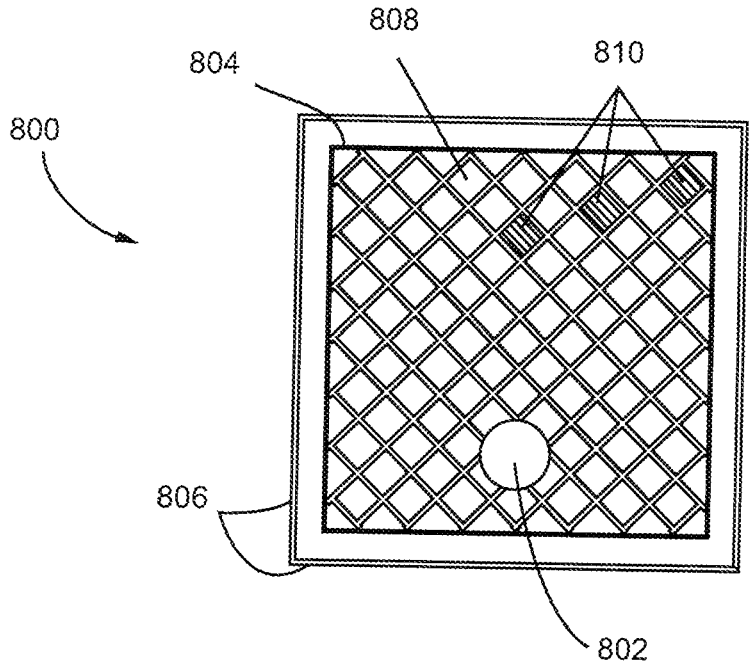
FIG. 8 is a schematic plan-view illustration of the underside of a groutless ceramic tile flooring unit wherein electronic components are disposed within the cavities within the underside of the substrate according to some embodiments of the present invention.

By way of illustration, FIG. 8 provides a view of one type of design for the underside of a groutless tile as shown in FIG. 1. The groutless tile 800 includes the substrate 804 and the decorative component 802 (of which the back side is shown in the cut-away circle). The substrate 804 includes the flange portions 806, which are disposed along the side edges or walls of the substrate 804 and are used to form the mechanical joints to couple adjacent groutless tiles. The substrate 804 also includes a plurality of cavities 808 into which any of the optional additional electrical connections, circuits, and components 810 associated with storing and utilizing the electricity generated by the mechanical-energy-harvesting devices can also be included.

These cavities 808, which can be formed when the substrate 804 is molded or by removing portions of the substrate 804 after the substrate has been manufactured, can be designed to accommodate the circuitry and/or other devices (e.g., capacitors, antennas, batteries, sensors, or the like) 810 associated with the mechanical-energy-harvesting device functions. Naturally, as described above, these cavities 808 can also serve as the location of the mechanical-energy-harvesting devices, when it is desirable to place these devices on the underside of the groutless tile flooring units.

In some cases, where a "network" of electrically interconnected flooring units are desired, the flanges 806, after molding and subsequent machining of the mechanical joint profile, can provide locations for placing the interconnections for the mechanical-energy-harvesting devices and associated electrical circuitry.

Figure 9:
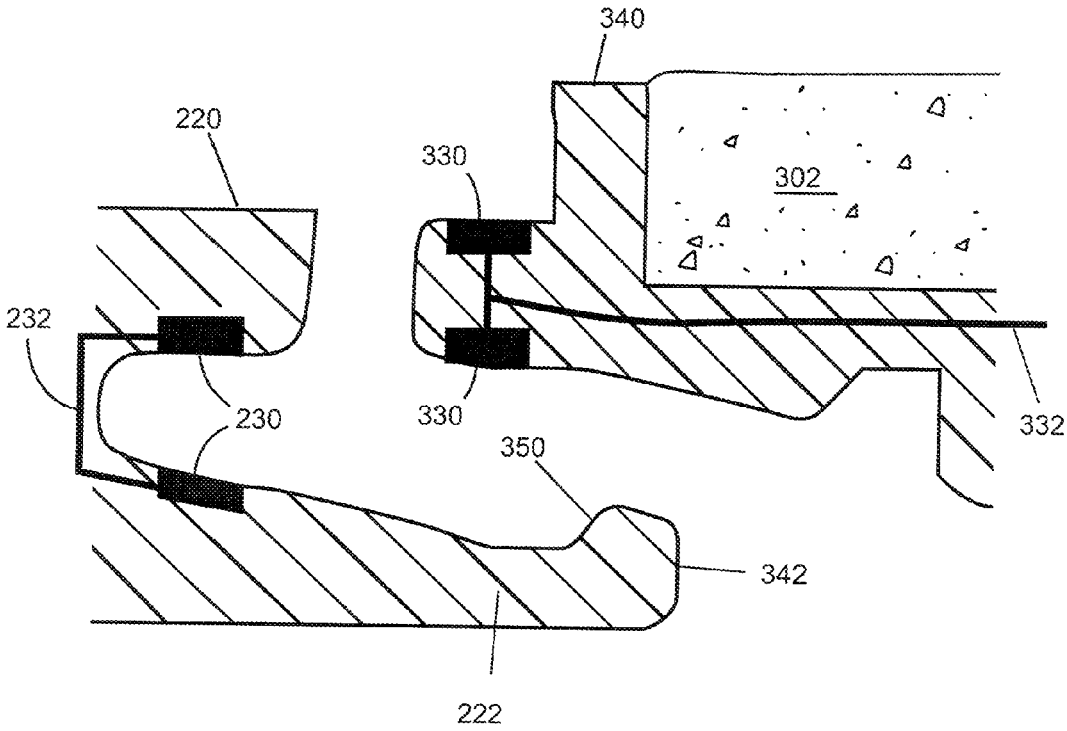
FIG. 9 is the schematic cross-sectional close-up inset of FIG. 3, further depicting locations within the mechanical joint profiles wherein conductive components are placed and the corresponding electrical paths through the groutless tile flooring unit substrates according to some embodiments of the present invention.
Figure 10:
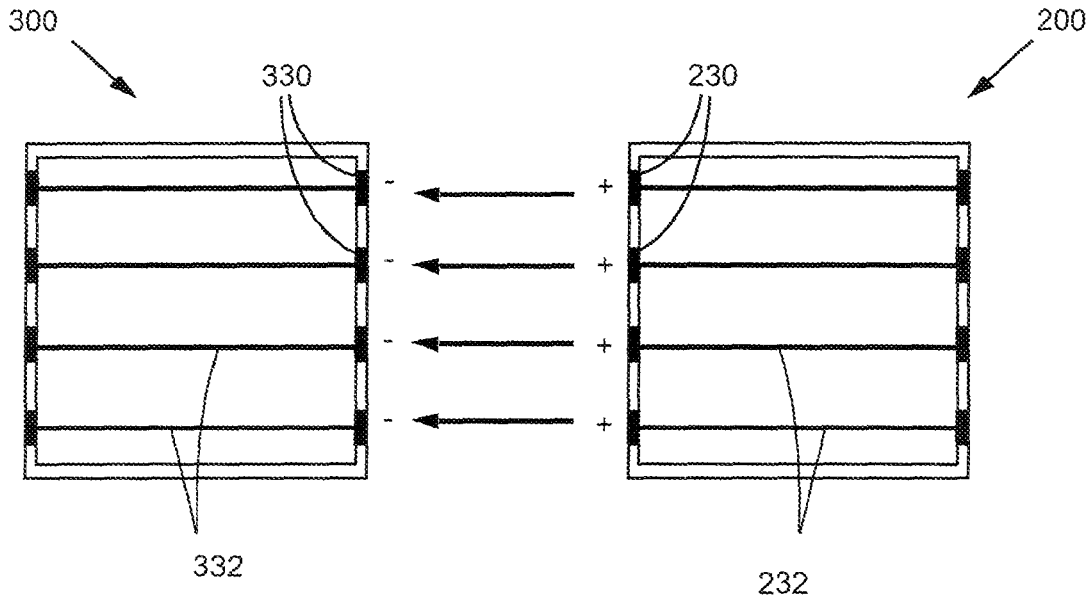
FIG. 10 is a schematic plan-view illustration of the topside of two groutless ceramic tile flooring units depicting various locations within the mechanical joint profiles wherein conductive components are placed and the corresponding electrical paths through the groutless tile flooring unit substrates according to some embodiments of the present invention.

By way of illustration, FIG. 9 provides a close-up view of the mechanical joint of the groutless ceramic tile system shown in FIGS. 1 through 3. The mechanical joint includes conductive circuit components integrated into the substrate around the ceramic tile decorative component 302. Portions of the conductive components 230 and 330 are disposed in each of the two primary mechanical joint profile components such that when they are assembled, a conductive path 232 and 332 is formed through the mechanical joint. The conductive components 230 and 330 could comprise distinct parts/components, which could be attached at specific locations on the mechanical joint profiles, or they could be conductive films, ribbons, coatings, or the like, that are applied to certain portions of the mechanical joint profiles after molding and machining. Regardless, the design of the mechanical joint profiles, the conductive components 230 and 330, and the placement of said components 230 and 330 is done with the intention to create a connection that is mechanically secure and electrically conductive. For example, FIG. 10 illustrates two groutless tiles 200 and 300 having multiple discrete electrical interconnections within each groutless tile. In this figure, four conductive components 230 and 330 are positioned at each mechanical joint profile of each groutless tile 200 and 300 in a manner as shown in FIG. 9. When the second groutless tile 300 is coupled with the first groutless tile 200, four conductive paths 230 and 330 are formed through the mechanical joint.

Any electricity generated by the mechanical-energy-harvesting devices can be used singly or in concert, via the electrically interconnected groutless tile units, to power electronic devices directly or to build up stored electrical charges in batteries, capacitors or the like, which can then be used for any other electrical purpose.

Reference was made above to floor systems where the flooring unit was a groutless tile, or a ceramic tile encased by a polymeric frame. This was done for convenience only and is not intended to be limiting on the various embodiments of the present invention in any way. It will be recognized by those skilled in the art that various other types of flooring units can be used in conjunction with the mechanical-energy-harvesting devices (and optional additional components and/or circuitry).

By way of example, another type of flooring unit that can be used to make the floor systems of the present invention includes those laminate wood flooring planks manufactured and sold by Unilin/Mohawk Corporation under the trademark QUICKSTEP™. Since each laminate floor plank does not have a separate decorative component and substrate like the groutless tile systems described above, the mechanical-energy-harvesting devices must be placed within the decorative component (i.e., laminate floor plank) itself. A mechanical-energy-harvesting device can be placed in the mechanical joint structure of such a laminate floor plank and/or in a groove or channel within the underside of the plank. Similarly, any additional components or circuitry can be placed in these locations as well.

Yet another type of flooring unit that can be used to make the floor systems of the present invention includes those types of carpet tile products that can be considered a type of floating floor. These carpet tiles can be constructed in a manner that houses the mechanical-energy-harvesting devices (and any additional components or circuitry) between the top decorative component (i.e., the carpet piece itself) and the bottom core/substrate layer (i.e., an supporting layers or underlayment layers). Alternatively, the mechanical-energy-harvesting devices can be placed in a channel or groove on the topside or underside of the bottom core/substrate layer(s). It is also possible for the mechanical-energy-harvesting devices to be encapsulated within the bottom core/substrate layer(s) when manufacturing of such layer(s) allows for this. Since the decorative component is highly compliant, it will absorb more impact from foot traffic (or other forces applied thereto during use), but will also transmit less vibrational energy from foot traffic (or other forces applied thereto during use). As a result, mechanical-energy-harvesting devices that are actuated by impact forces or strain (such as piezoelectric material based devices) could produce more electricity in this type of flooring unit than the same device feeling the same impact will produce in a more rigid flooring unit. Conversely, mechanical-energy-harvesting devices that are actuated by vibration (such as magneto-inductive or electrostatic material based devices) will produce less electricity in this type of flooring unit than the same device feeling the same impact will produce in a more rigid flooring unit. It should be noted that, because of the compliance of the decorative component, the mechanical-energy-harvesting devices used with this type of flooring unit will need to be more durable than those used with more rigid types of flooring units.

Regardless of the type of flooring unit used, the floating floor systems of the present invention can be used in a variety of applications. In operation of the floating floor systems, a person will step/walk/run on, or drop/roll/drag an item across, the decorative components of the flooring units that comprise the floating floor systems. Alternatively, the flooring units can be vibrated in response to an external source of vibration, such as traffic, a nearby train, footsteps on other flooring units in the floor system, wind, and the like. For those flooring units that comprise a mechanical-energy-harvesting device, the mechanical motion or vibration of the flooring unit will be converted into electrical energy.

In some cases, this electrical energy can be transferred to an energy storage device (e.g., a battery, capacitor, supercapacitor, and the like) for later use. The energy storage device can be included as part of the same flooring unit, another flooring unit, or be separate from the flooring system components. The mechanical-energy-harvesting device can be in electrical communication with the optional energy storage device via any necessary circuitry.

By way of example, FIG. 7 illustrates an energy storage device located on the same flooring unit as the mechanical-energy-harvesting device. Thus, the mechanical-energy-harvesting device 710 can transfer any electricity produced to the energy storage device 712. While the energy storage device 712 is shown as being positioned in a channel or groove within the substrate 704 of the groutless tile flooring unit, this is done for illustrative convenience. The location for the energy storage device 712 can be varied as described above.

In some cases, the electrical energy can be transferred to an electronic component that will be actuated by the resultant electrical energy. Examples of such electronic components include antennas, sensors, transmitters, receivers, cameras, electrical switches, and the like.

By way of illustration, antennas and related components can be incorporated into the flooring units for transmitting and receiving radiofrequency (RF) signals. The use of electro-magnetic radiation in the RF bands as a means for distributing information is a nearly ubiquitous part of modern life. Typically, the transmission and reception of RF signals is accomplished using antenna structures of various types. The optimum size and design for a given antenna is highly dependent upon the intended use, where position or location, range, frequency band(s), general performance and service life all play a part in the design. For applications inside buildings, the antennas deployed typically form a component of a wireless network, where a number or multitude of transmitter/receiver antennas are used to move wireless data throughout the interior (or even outside) of the building. Such devices would generally be described as discrete and separate units that do not form part of the interior decoration of the space. As such, these devices are not decorative, and it is desirable that they be relatively small and unobtrusive. To the extent that such design constraints do not fatally compromise their function and performance, the antennas for these devices are made as small as possible.

The performance of an antenna, which is essentially a two-dimensional conductive circuit of some preferred pattern, is based on many factors, one of which is the available space. The efficiency with which the antenna transmits or in particular collects the RF signal of interest is directly related to its absorption cross-section, which is influenced by its size or surface area. In certain instances, it may be desirable to improve the antenna performance by increasing its size; however, the limitations of available space or the need to be unobtrusive might render such improvements impossible.

The flooring units of the floor systems described herein allow for the unobtrusive deployment of larger antenna structures than what might normally be acceptable inside buildings, leading to new wireless network strategies, increased performance and/or lower overall system costs. The mechanical joints of the flooring units facilitate the unobtrusive placement of the electrical interconnections that are needed for power/signal to and from the antenna. The ability to electrically interconnect the various flooring units also allows for the formation of an array of antennas, or a large single antenna across the entire floor system.

In addition to functioning to send and receive wireless data transmissions, the large antenna or antenna arrays can also serve as a means for harvesting stray RF energy and converting it into some other beneficial use. Conversely, the antenna or antenna array can be used to transmit RF energy for the purpose of acting as a power source to activate nearby electronic devices or recharge energy storage devices. Yet another use involves electro-magnetic shielding, wherein the antenna structure is employed specifically to preferentially absorb RF energy of a particular frequency or band of frequencies.

In conjunction with an antenna, the floor system can also include a temperature, humidity, or pressure sensor that can be activated by the mechanical-energy-harvesting device. The temperature, humidity, or pressure sensor, once activated, can measure local temperature, humidity, or pressure values and transmit this data to an external device via an antenna (which, preferably, is as described above).

By way of example, FIG. 6 illustrates a flooring unit that includes such a sensor and an antenna, which are actuated by the mechanical-energy-harvesting device. Thus, the mechanical-energy-harvesting device 610 can transfer any electricity produced to the sensor 612. The sensor 612 can measure a specific data (e.g., temperature, humidity, and/or pressure) value, and transmit this data using the antenna 614 to an external device (not shown). While the sensor 612 and antenna 614 is shown as being positioned on the surface of the underside of the substrate 604 of the groutless tile flooring unit, this is done for illustrative convenience. The locations of the sensor 612 and/or antenna 614 can be varied as described above.

The embodiments of the present invention are not limited to the particular components, process steps, and materials disclosed herein as such components, process steps, and materials may vary somewhat. Moreover, the terminology employed herein is used for the purpose of describing exemplary embodiments only and the terminology is not intended to be limiting since the scope of the various embodiments of the present invention will be limited only by the appended claims and equivalents thereof.

Therefore, while embodiments of this disclosure have been described in detail with particular reference to exemplary embodiments, those skilled in the art will understand that variations and modifications can be effected within the scope of the disclosure as defined in the appended claims. Accordingly, the scope of the various embodiments of the present invention should not be limited to the above discussed embodiments, and should only be defined by the following claims and all equivalents.

What is claimed is:

1. A floating flooring unit, comprising:

a decorative component; and a mechanical-energy-harvesting-device, wherein the mechanical-energy-harvesting-device is disposed on or within a mechanical joint profile of the floating flooring unit, wherein the mechanical joint profile of the floating flooring unit is configured to couple the floating flooring unit to an adjacent floating flooring unit.

2. The floating flooring unit of claim 1, further comprising an energy storage device.

3. The floating flooring unit of claim 1, further comprising an electronic component configured to be actuated by any electricity generated by the mechanical-energy-harvesting-device.

4. The floating flooring unit of claim 3, wherein the electronic component is an antenna, pressure sensor, humidity sensor, temperature sensor, transmitter, or electrical switch.

5. The floating flooring unit of claim 1, further comprising a conductive circuit component disposed on or within the mechanical joint profile and circuitry for electrically interconnecting the floating flooring unit with the adjacent floating flooring unit.

6. The floating flooring unit of claim 1, wherein the floating flooring unit is a groutless tile flooring unit, wherein the decorative component is a tile disposed within a groove of a substrate, wherein the substrate comprises the mechanical joint profile.

7. The floating flooring unit of claim 6, wherein the groutless tile flooring unit further comprises an energy storage device.

8. The floating flooring unit of claim 6, wherein the groutless tile flooring unit further comprises an electronic component configured to be actuated by any electricity generated by the mechanical-energy-harvesting-device.

9. The floating flooring unit of claim 6, wherein the groutless tile flooring unit further comprises a conductive circuit component disposed on or within the mechanical joint profile of the substrate and circuitry for electrically interconnecting the groutless tile flooring unit with an adjacent groutless tile flooring unit.

10. The floating flooring unit of claim 1, wherein the mechanical-energy-harvesting-device is a piezoelectric material-containing device, a magneto-inductive device, or an electrostatic structure-containing device.

11. The floating flooring unit of claim 10, wherein the mechanical-energy-harvesting-device is a microelectromechanical device.

12. A floating floor system, comprising:

a floating flooring unit comprising a decorative component and a mechanical-energy-harvesting-device, wherein the mechanical-energy-harvesting-device is disposed on or within a mechanical joint profile of the floating flooring unit, wherein the mechanical joint profile of the floating flooring unit is configured to couple the floating flooring unit to an adjacent floating flooring unit within the floating floor system.

13. The floating flooring system of claim 12, further comprising an energy storage device.

14. The floating flooring system of claim 12, further comprising an electronic component configured to be actuated by any electricity generated by the mechanical-energy-harvesting-device.

15. The floating flooring system of claim 14, wherein the electronic component is an antenna, pressure sensor, humidity sensor, temperature sensor, transmitter, camera, or electrical switch.

16. The floating flooring system of claim 12, further comprising a conductive circuit component disposed on or within the mechanical joint profile and circuitry for electrically interconnecting the floating flooring unit with the adjacent floating flooring unit.

17. The floating flooring system of claim 12, wherein the floating flooring unit is a groutless tile flooring unit, wherein the decorative component is a tile disposed within a groove of a substrate, wherein the substrate comprises the mechanical joint profile.

18. The floating flooring system of claim 17, wherein the groutless tile flooring unit further comprises an energy storage device.

19. The floating flooring system of claim 17, wherein the groutless tile flooring unit further comprises an electronic component configured to be actuated by any electricity generated by the mechanical-energy-harvesting-device.

20. The floating flooring system of claim 19, wherein the electronic component is disposed on or within an underside of the substrate.

21. The floating flooring system of claim 17, wherein the groutless tile flooring unit further comprises a conductive circuit component disposed on or within the mechanical joint profile of the substrate and circuitry for electrically interconnecting the groutless tile flooring unit with an adjacent groutless tile flooring unit.

22. The floating flooring system of claim 12, wherein the mechanical-energy-harvesting-device is a piezoelectric material-containing device, a magneto-inductive device, or an electrostatic structure-containing device.

23. The floating flooring system of claim 22, wherein the mechanical-energy-harvesting-device is a microelectromechanical device.

24. A method of generating electrical energy, the method comprising:

exerting a force on a floating floor system, wherein the floating floor system comprises a floating flooring unit comprising a decorative component and a mechanical-energy-harvesting-device, wherein the mechanical-energy-harvesting-device is disposed on or within a mechanical joint profile of the floating flooring unit, and wherein the mechanical joint profile of the floating flooring unit is configured to couple the floating flooring unit to an adjacent floating flooring unit within the floating floor system; and transferring the force to the mechanical-energy-harvesting-device; and producing electricity from the mechanical-energy-harvesting-device.

25. The method of claim 24, further comprising delivering the electricity to an energy storage device.

26. The method of claim 24, further comprising:

delivering the electricity to an electronic component configured to be actuated by the electricity produced by the mechanical-energy-harvesting device; and actuating the electronic component.

27. The method of claim 24, wherein exerting the force comprises stepping on the floating flooring unit or contacting an inanimate object to the floating flooring unit.

28. The method of claim 24, wherein transferring the force comprises impacting the mechanical-energy-harvesting-device, straining the mechanical-energy-harvesting-device, or vibrating the mechanical-energy-harvesting-device.

* * * * *